US007174760B2

(12) United States Patent
Hu

(10) Patent No.: US 7,174,760 B2
(45) Date of Patent: Feb. 13, 2007

(54) DUAL-DIRECTIONAL PIPE-BENDING MACHINE

(75) Inventor: Ping-Kun Hu, Tainen Hsien (TW)

(73) Assignee: Ying Lin Machine Industrial Co., Ltd., Tainan Hsien (TW)

( * ) Notice: Subject to any disclaimer, the term of this patent is extended or adjusted under 35 U.S.C. 154(b) by 0 days.

(21) Appl. No.: 11/097,317

(22) Filed: Apr. 4, 2005

(65) Prior Publication Data

US 2005/0268681 A1 Dec. 8, 2005

(30) Foreign Application Priority Data

Jun. 8, 2004 (TW) ..... 93116393 A

(51) Int. Cl.
*B21D 7/04* (2006.01)

(52) U.S. Cl. ..... 72/157; 72/307

(58) Field of Classification Search ..... 72/149, 72/157, 307

See application file for complete search history.

(56) References Cited

U.S. PATENT DOCUMENTS 4,843,859 A * 7/1989 Togoshi ..... 72/149
5,263,350 A * 11/1993 Crippa ..... 72/157
6,434,993 B1 * 8/2002 Broggi et al. ..... 72/157

* cited by examiner

*Primary Examiner*—Lowell A. Larson
(74) *Attorney, Agent, or Firm*—Rosenberg, Klein & Lee

(57) ABSTRACT

A dual-directional pipe-bending machine bends a pipe in either direction and has a base, a transporting device and a pipe-bending assembly. The base has a bracket. The transporting device is mounted slidably on the bracket. The pipe is mounted on the transporting device. The pipe-bending assembly is mounted on the base and has a transversely moving bracket, a vertically moving bracket, a location-changing assembly, a rotating transmission device, a rotating bracket and two pipe-bending devices. The transversely and vertically moving brackets are mounted on the base. The location-changing assembly moves the transversely moving bracket and the vertically moving bracket. The rotating bracket connects to the vertically moving bracket. The rotating transmission device rotates the rotating bracket. The two pipe-bending devices are mounted on the rotating bracket.

4 Claims, 5 Drawing Sheets

DUAL-DIRECTIONAL PIPE-BENDING MACHINE

BACKGROUND OF THE INVENTION

1. Field of the Invention

The present invention relates to a pipe-bending machine, especially to a dual-directional pipe-bending machine.

2. Description of the Prior Arts

Pipe-bending machine are used to bend pipes. The conventional pipe-bending machine comprises a rotatable bending bracket and a pivot arm pivotable about the axis of the bending bracket and supporting a chuck. To be able to make right-hand bends as well as left-hand bends in a pipe, the bending bracket comprises a two-bracket assembly with the individual brackets oriented to bend pipe in different directions. The chuck also comprises jaw parts for different bending directions. The pipe is moved between the two brackets to be bent by one of the brackets. Although the conventional pipe-bending machine can provide two directional bending, one of the brackets limits the bending angle of the pipe when the other bracket bends the pipe.

Another conventional pipe-bending machine comprises a machine frame, a first bending head, a second bending head, a cross slide and a pipe holding device. The bending heads are mounted on the machine frame, bend configured so as to be mirror-inverted with respect to each other and projects in cantilever-like from the machine frame. The cross slide supports the pipe holding device and selectively moves the pipe holding device to correspond to the first or second bending head. Although the first and second bending head do not influence each other when bending the pipe, the volume of the pipe-bending machine is huge to accommodate the two bending heads. Furthermore, a long pipe easily is vibrated when the cross slide moves the pipe holding device. The vibration of the pipe keeps the bend in the pipe from being precise.

To overcome the shortcomings, the present invention provides a dual-directional pipe-bending machine to mitigate or obviate the aforementioned problems.

SUMMARY OF THE INVENTION

The main objective of the present invention is to provide a dual-directional pipe-bending machine. The dual-directional pipe-bending machine bends a pipe in either direction and has a base, a transporting device and a pipe-bending assembly. The base has a bracket. The transporting device is mounted slidably on the bracket. The pipe is mounted on the transporting device. The pipe-bending assembly is mounted on the base and has a transversely moving bracket, a vertically moving bracket, a location-changing assembly, a rotating transmission device, a rotating bracket and two pipe-bending devices. The transversely and vertically moving brackets are mounted on the base. The location-changing assembly moves the transversely moving bracket and the vertically moving bracket. The rotating bracket connects to the vertically moving bracket. The rotating transmission device rotates the rotating bracket. The two pipe-bending devices are mounted on the rotating bracket.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
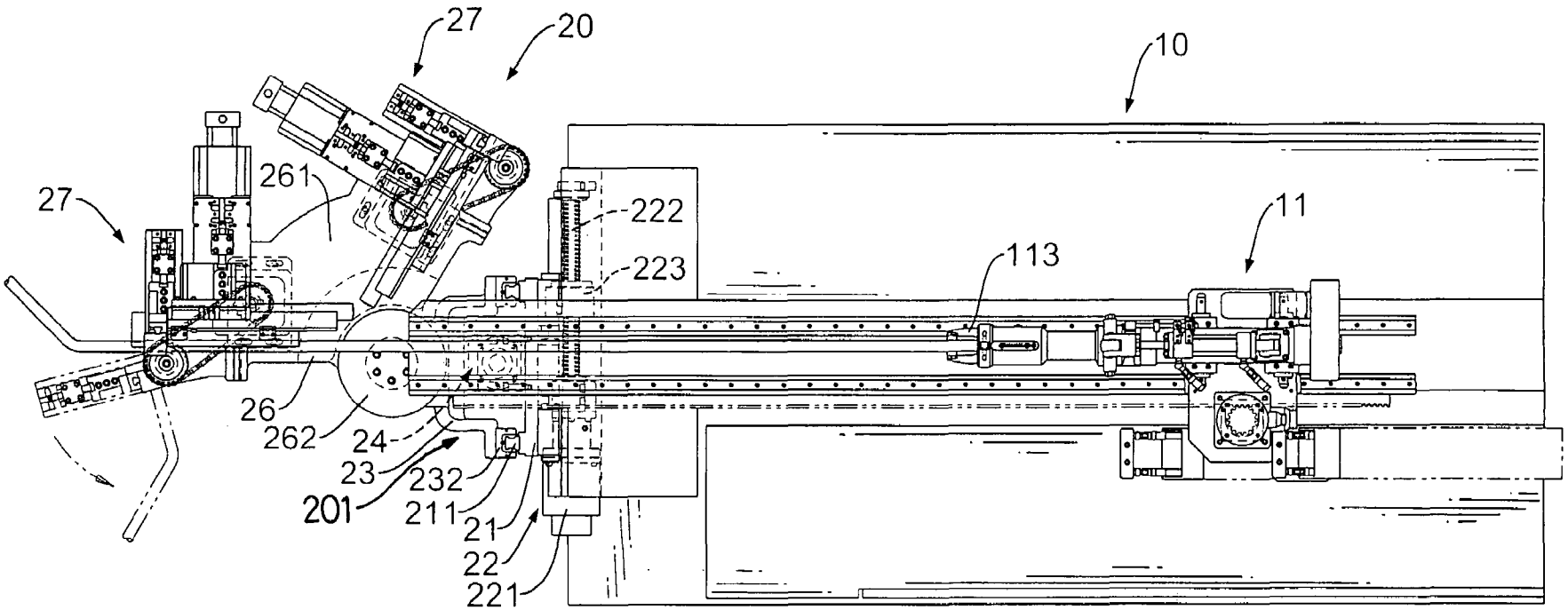
FIG. 1 is an operational top view of a dual-directional pipe-bending machine in accordance with the present invention.
Figure 2:
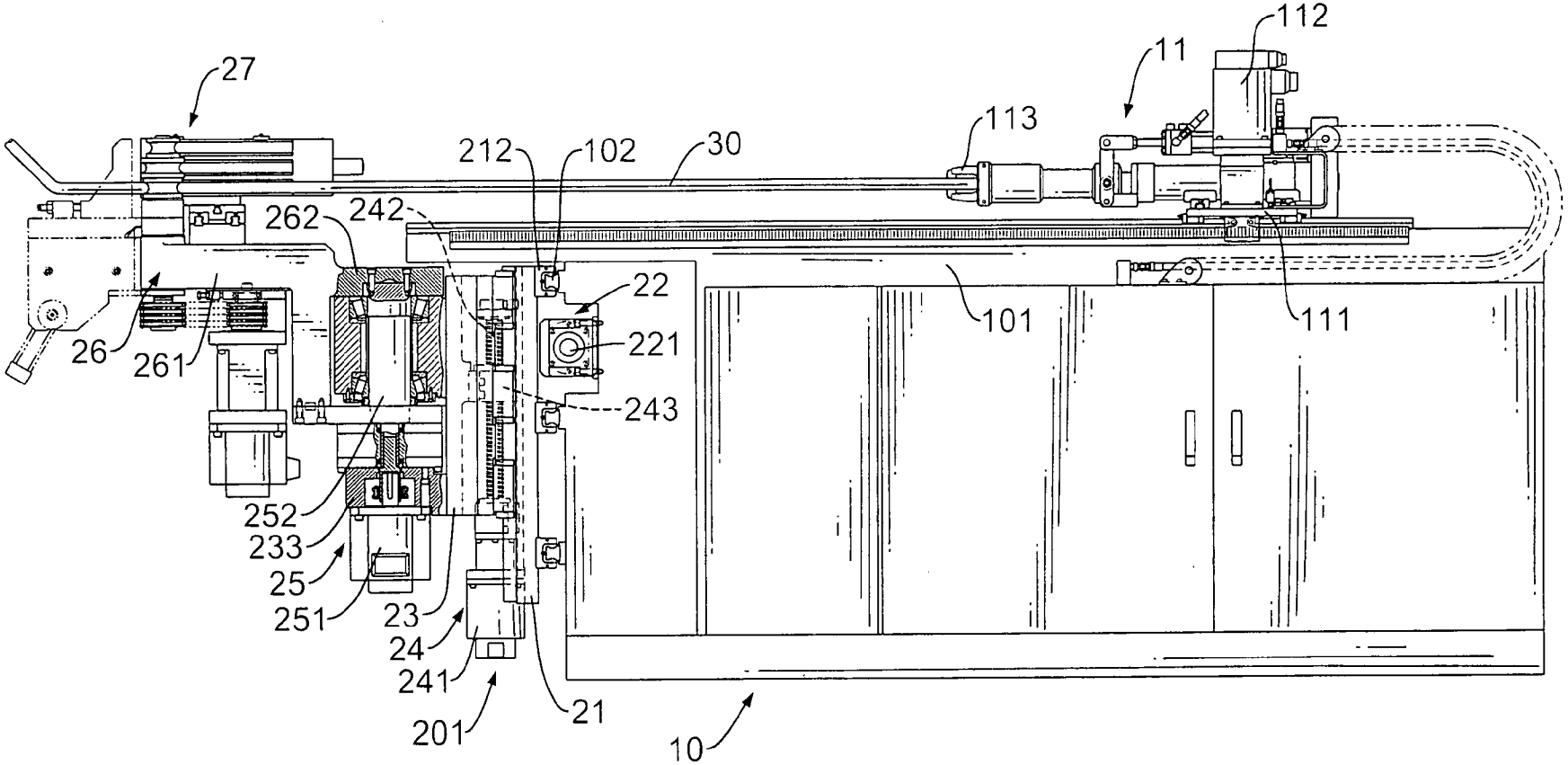
FIG. 2 is a side view of the dual-directional pipe-bending machine in FIG. 1.

With reference to FIGS. 1 and 2, a dual-directional pipe-bending machine in accordance with the present invention comprises a base (10), a transporting device (11) and a pipe-bending assembly (20).

The base (10) has a top, a front, a bracket (101) and three optional protrusions (102). The bracket (101) is mounted on the top of the base (10). The protrusions (102) are formed on and protrude from the front of the base (10).

The transporting device (11) is mounted slidably on the bracket (101) and has a slide (111), a transmission device (112) and a chuck (113). The slide (111) is mounted slidably on the bracket (101). The transmission device (112) is mounted on the slide (111) and moves the slide (111) on the bracket (101). The chuck (113) is mounted on the slide (111).

The pipe-bending assembly (20) is mounted on the front of the base (10) and has a transversely moving bracket (21), a vertically moving bracket (23), a location-changing assembly (201), a rotating transmission device (25), a rotating bracket (26) and two pipe-bending devices (27).

The transversely moving bracket (21) is mounted slidably on the front of the base (10) and may have a front surface, a rear surface, at least one mounting recess, three slots (212) and two protrusions (211). The at least one mounting recess is formed in the rear surface of the transversely moving bracket (21). The slots (212) are formed on the rear surface of the transversely moving bracket (21) and are mounted respectively on the protrusions (102). The protrusions (211) are formed on the front of the transversely moving bracket (21).

The vertically moving bracket (23) is mounted slidably on the transversely moving bracket (21) and may have a front surface, a rear surface, at least one mounting recess, two slots (232) and two positioning elements (233). The at least one mounting recess is formed in the rear surface of the vertically moving bracket (23). The slots (232) are formed transversely on the rear surface of the vertically moving bracket (23) and correspond to and engage the protrusions (211) on the transversely moving bracket (21). The positioning elements (233) are formed on the front surface of the vertically moving bracket (23).

The location-changing assembly (201) connects to the transversely moving bracket (21) and the vertically moving bracket (23) and has a transverse transmission device (22) and an elevation transmission device (24).

The transverse transmission device (22) connects to the transversely moving bracket (21) to move the transversely moving bracket (21) transversely and may have a servomotor (221) and a threaded rod (222). The servomotor (221) is mounted on the front of the base (10). The threaded rod (222) connects to and is rotated by the servomotor (221) and has at least one driver (223). The at least one driver (223) is mounted on and is driven by the threaded rod (222) and corresponds and attaches to the at least one mounting recess in the transversely moving bracket (21) to move the transversely moving bracket (21) when the threaded rod (222) turns.

Figure 5:
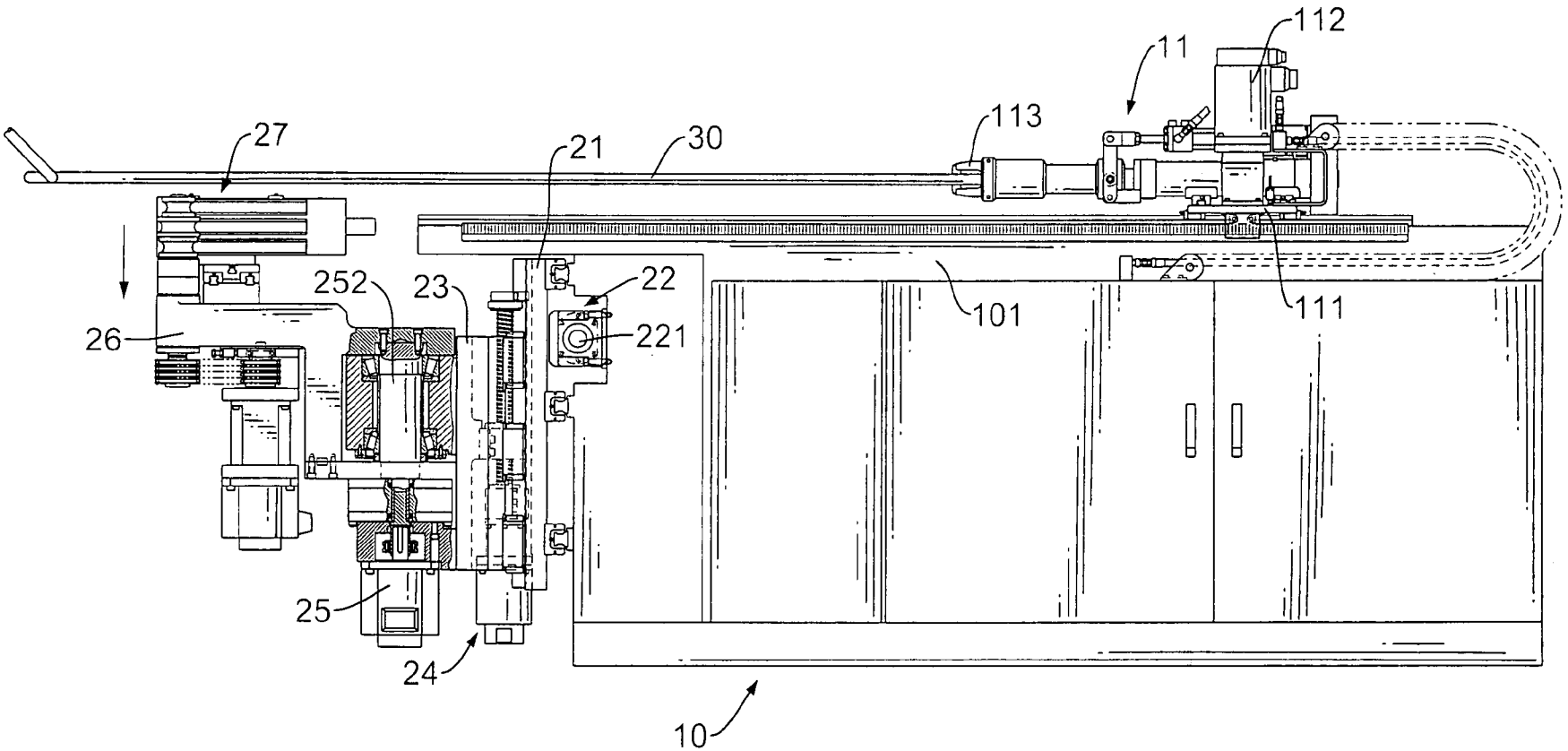
FIG. 5 is an operational side view of the dual-directional pipe-bending machine in FIG. 1.

With further reference to FIG. 5, the elevation transmission device (24) connects to the vertically moving bracket to move the vertically moving bracket (23) vertically and may have a servomotor (241) and a threaded rod (242). The servomotor (241) is mounted on the front surface of the transversely moving bracket (21). The threaded rod (242) connects to and is rotated by the servomotor (241) and has at least one driver (243). The at least one driver (243) is mounted on and is driven by the threaded rod (242) and corresponds and attaches to the at least one mounting recess in the vertically moving bracket (23) to move the vertically moving bracket (23) when the threaded rod (242) turns.

The rotating transmission device (25) connects to the vertically moving bracket (23) and may have a servomotor (251) and a rotating shaft (252). The servomotor (251) is attached to one of the positioning elements (233). The rotating shaft (252) is mounted rotatably through the positioning elements (233), connects to and is rotated by the servomotor (251) of the rotating transmission device (25) and has a top end.

The rotating bracket (26) is mounted securely on and is rotated by the rotating transmission device (25), may be mounted securely on the top end of the rotating shaft (252) and may have a pivoting base (262) and a rotating base (261). The pivoting base (262) is mounted pivotally on the top end of the rotating shaft (252). The rotating base (261) is formed on the pivoting base (262) and has two ends.

The pipe-bending devices (27) are separately mounted securely on the rotating bracket (26) and may be mounted respectively on the two ends of the rotating base (261). Each pipe-bending device (27) has an operating direction opposite to each other.

Figure 3:
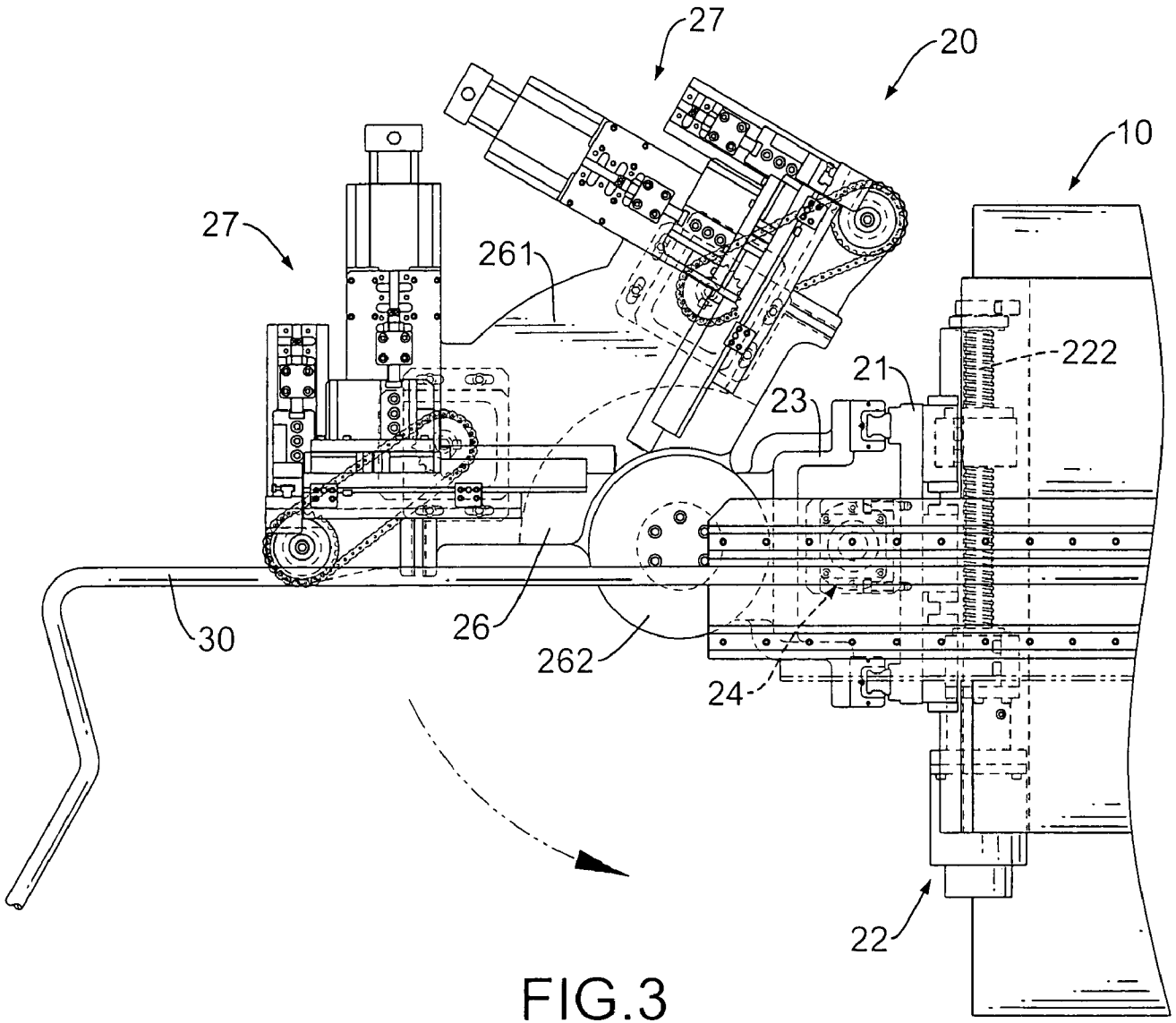
FIG. 3 is an enlarged top view of the pipe-bending assembly of the dual-directional pipe-bending machine in FIG. 1.
Figure 4:
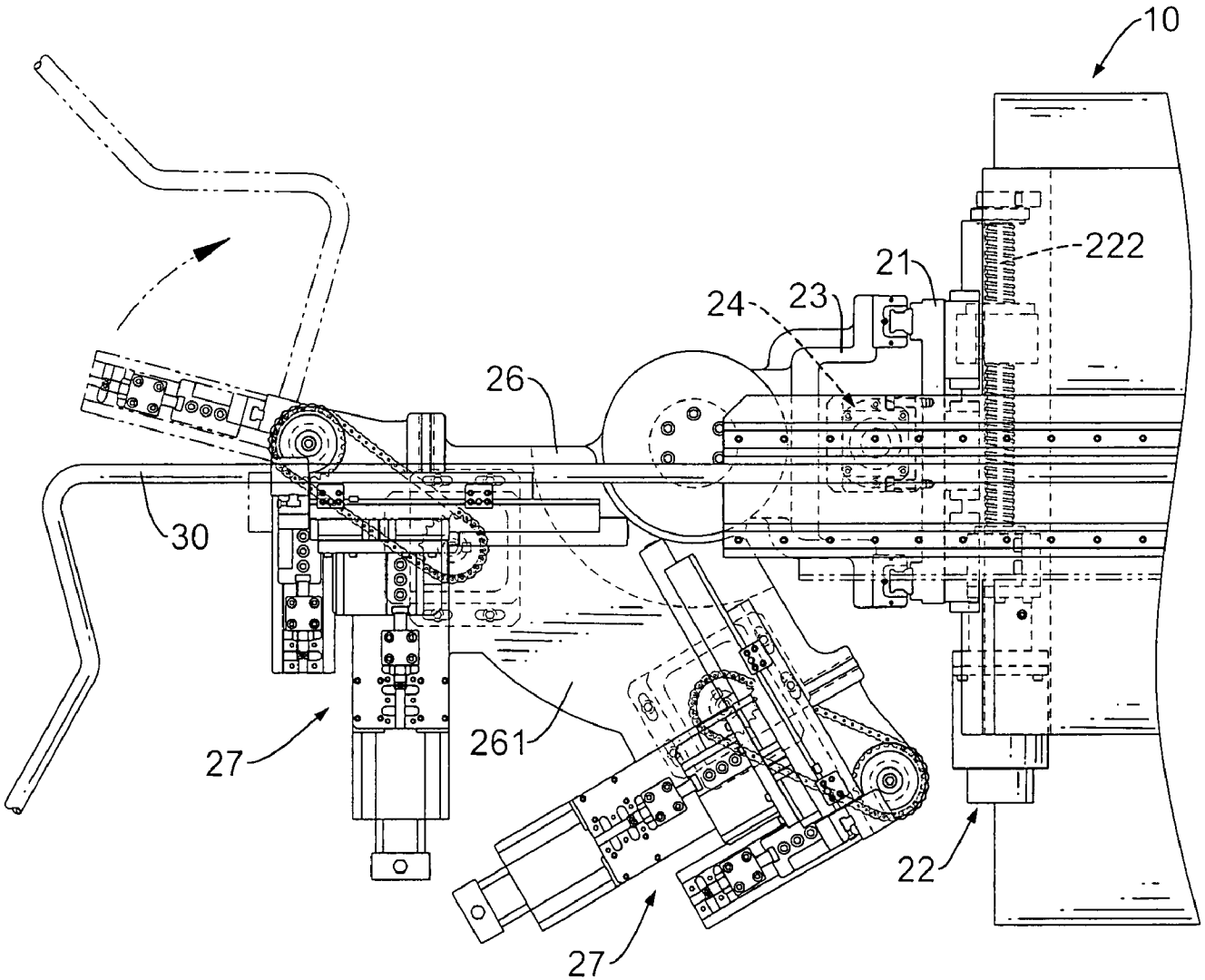
FIG. 4 is an operational top view of the pipe-bending assembly of the dual-directional pipe-bending machine in FIG. 3.

With further reference to FIGS. 3 and 4, a pipe (30) is mounted in the chuck (113). The transmission device (112) of the transporting device (11) moves the slide (111) and the chuck (113) forward. One of the pipe-bending devices (27) bends the pipe (30) in a right-hand direction, or the other pipe-bending device (27) bends the pipe (30) in a left-hand direction.

When one of the pipe-bending devices (27) not in an operating position needs to be moved to the operating position, the elevation transmission device (24) moves the vertically moving bracket (23) downward. The transverse transmission device (22) moves the transversely moving bracket (21) right or left, and the rotating transmission device (25) rotates the rotating bracket (26). Then the elevation transmission device (24) moves the vertically moving bracket (23) upward, and the pipe-bending device (27) is located at the operating position.

The dual-directional pipe-bending machine as described has numerous advantages. Because the operating directions of the pipe-bending devices (27) do not face each other, the pipe-bending devices (27) do not influence each other when one of the pipe-bending device (27) bends the pipe (30), and the volume of the dual-directional pipe-bending machine is reduced. The pipe-bending devices (27) are easily changed to the operation position with the location-changing assembly (201), the rotating transmission device (25) and the rotating bracket (26).

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A dual-directional pipe-bending machine comprising a base having atop;

a front; and a bracket mounted on the top of the base;

a transporting device mounted slidably on the bracket and having a slide mounted slidably on the bracket;

a transmission device mounted on the slide and moving the slide on the bracket; and a chuck mounted on the slide; and a pipe-bending assembly mounted on the front of the base and having a transversely moving bracket mounted slidably on the front of the base;

a vertically moving bracket mounted slidably on the transversely moving bracket;

a location-changing assembly connecting to the transversely moving bracket and the vertically moving bracket and having a transverse transmission device connecting to the transversely bracket to move the transversely moving bracket transversely; and an elevation transmission device connecting to the vertically moving bracket to move the vertically moving bracket vertically;

a rotating transmission device connecting to the vertically moving bracket;

a rotating bracket mounted securely on and rotated by the rotating transmission device; and two pipe-bending devices separately mounted securely on the rotating bracket, and each pipe-bending device having an operating direction opposite to each other.

2. The dual-directional pipe-bending machine as claimed in claim 1, wherein the base further has three protrusions formed on and protruding from the front of the base;

the transversely moving bracket has a front surface;

a rear surface;

at least one mounting recess formed in the rear surface of the transversely moving bracket; and three slots formed on the rear surface of the transversely moving bracket and mounted respectively on the protrusions on the base; and the transverse transmission device has a servomotor mounted on the front of the base; and a threaded rod connecting to and rotated by the servomotor and having at least one driver mounted on and driven by the threaded rod and corresponding and attached to the at least one mounting recess in the transversely moving bracket.

3. The dual-directional pipe-bending machine as claimed in claim 2, wherein the transversely moving bracket further has two protrusions formed on the front surface of the transversely moving bracket;

the vertically moving bracket has a front surface;

a rear surface;

at least one mounting recess formed in the rear surface of the vertically moving bracket;

two slots formed on the rear surface of the vertically moving bracket and correspond to and engage the protrusions on the transversely moving bracket;

the elevation transmission device has a servomotor mounted on the front surface of the transversely moving bracket; and a threaded rod connecting to and rotated by the servomotor and having at least one driver mounted on and driven by the threaded rod and corresponding and attached to the at least one mounting recess in the vertically moving bracket.

4. The dual-directional pipe-bending machine as claimed in claim 3, wherein the vertically moving bracket has two positioning elements formed on the front surface of the vertically moving bracket;

the rotating transmission device has a servomotor attached to the positioning element; and a rotating shaft mounted rotatably through the positioning elements, connecting to and rotated by the servomotor of the rotating transmission device and having a top end;

the rotating bracket is mounted securely on the top end of the rotating shaft and has a pivoting base mounted pivotally on the top end of the rotating shaft; and a rotating base formed on the pivoting base and having two ends; and the pipe-bending devices are mounted respectively on the two ends of the rotating base.

* * * * *